United States Patent [19]

Kiernan

[11] 4,036,500

[45] July 19, 1977

[54] ELECTRICAL GAME DEVICE

[76] Inventor: James T. Kiernan, 2 Hamlet Road, Levittown, Pa. 19056

[21] Appl. No.: 654,477

[22] Filed: Feb. 2, 1976

[51] Int. Cl.[2] ..... A63F 3/00

[52] U.S. Cl. ..... 273/130 AB; 273/1 E

[58] Field of Search ..... 273/1 E, 130 AB, 130 B, 273/135 A, 136 A

[56] References Cited

U.S. PATENT DOCUMENTS

| | | | |
|---|---|---|---|
| 2,356,057 | 8/1944 | Householder | 273/136 A |
| 2,799,505 | 7/1957 | Lyons | 273/136 A |
| 2,844,374 | 7/1958 | French | 273/1 E |
| 3,152,805 | 10/1964 | McGinn | 273/136 A |
| 3,563,552 | 2/1971 | Korff | 273/135 A |
| 3,779,533 | 12/1973 | Secter | 273/130 AB |

FOREIGN PATENT DOCUMENTS

| | | | |
|---|---|---|---|
| 1,176,985 | 12/1958 | France | 273/130 AB |

*Primary Examiner*—Anton O. Oechsle
*Assistant Examiner*—Harry G. Strappello
*Attorney, Agent, or Firm*—Howson & Howson

[57] ABSTRACT

A game board divided into a series of playing spaces which are arranged in a preselected pattern and which are capable of being selectively illuminated during the playing of a game with playing pieces movable on the board. The playing spaces are illuminated by a series of control switches which are mounted at each of four playing spaces extending outwardly from opposite sides of the game board and which correspond in number and arrangement to the playing spaces as viewed from each playing station. A circuit connects the control switches in pairs in such a manner as to cause a playing space to be illuminated when an odd number of control switches for that space are in the on position and to prevent a space from being illuminated when an even number of control switches for that space are in the on position. After the switches have been set at the beginning of each player's turn, electrical power is simultaneously supplied to the game board to illuminate all those playing spaces for which an odd number of switches have been placed in the on position. Preferably, each playing station is provided with a shield to conceal the control switches at one playing station from view by a player situated at a different playing station.

7 Claims, 5 Drawing Figures

ELECTRICAL GAME DEVICE

The present invention relates to amusement devices, and more particularly, the present invention relates to game devices wherein playing pieces are moveable over selectively illuminated playing spaces on a game board.

Over the years, some of the most successful adult games have been ones wherein the one player matches wits with one or more other players. Examples of such games include: checkers, chess, tic-tac-toe, etc. Although there are presently on the market various games, such as these, which may be entirely satisfactory, there is a continuous demand for devices on which challenging games can be played either by children or by adults.

With the foregoing in mind, it is a primary object of the present invention to provide a novel game device on which a number of different challenging games can be played either by children or by adults.

It is another object of the present invention to provide a unique game device which can be used to play games wherein the wits of one player are pitted against the wits of one or more players.

As a further object, the present invention provides a game device which can be used to play a variety of interesting and challenging games.

A still further object of the present invention is to provide a game device having a board with control stations for selectively illuminating playing spaces to afford movement of playing pieces on the board.

More specifically, in the present invention a translucent game board is divided into a series of playing spaces arranged in a predetermined pattern. Four playing stations extend in opposite directions away from the playing board. Lamps are provided in a partitioned grid located below the board for separately illuminating each playing space. A series of control switches are connected by circuit means to the lamps so that one switch at each station controls the illumination of one playing space. The switches have actuators mounted at the playing stations and arranged so as to correspond with the arrangement of the playing spaces of the board when the board is viewed from the playing station. A shield is provided between each playing station and the game board for concealing the switch actuators at one playing station from view from the other playing stations. A master switch is provided to power those lamps, and hence to illuminate those spaces, for which an odd number of switches are on. A method of using the game device is disclosed whereby any of a number of different games may be played by moving playing pieces according to prescribed rules over lighted playing spaces. If desired, a modified device having a board and only one pair of similarly constructed playing stations may be provided.

These and other objects, features and advantages of the present invention should become apparent from the following description when taken in conjunction with the accompanying drawings, in which.

Figure 1:
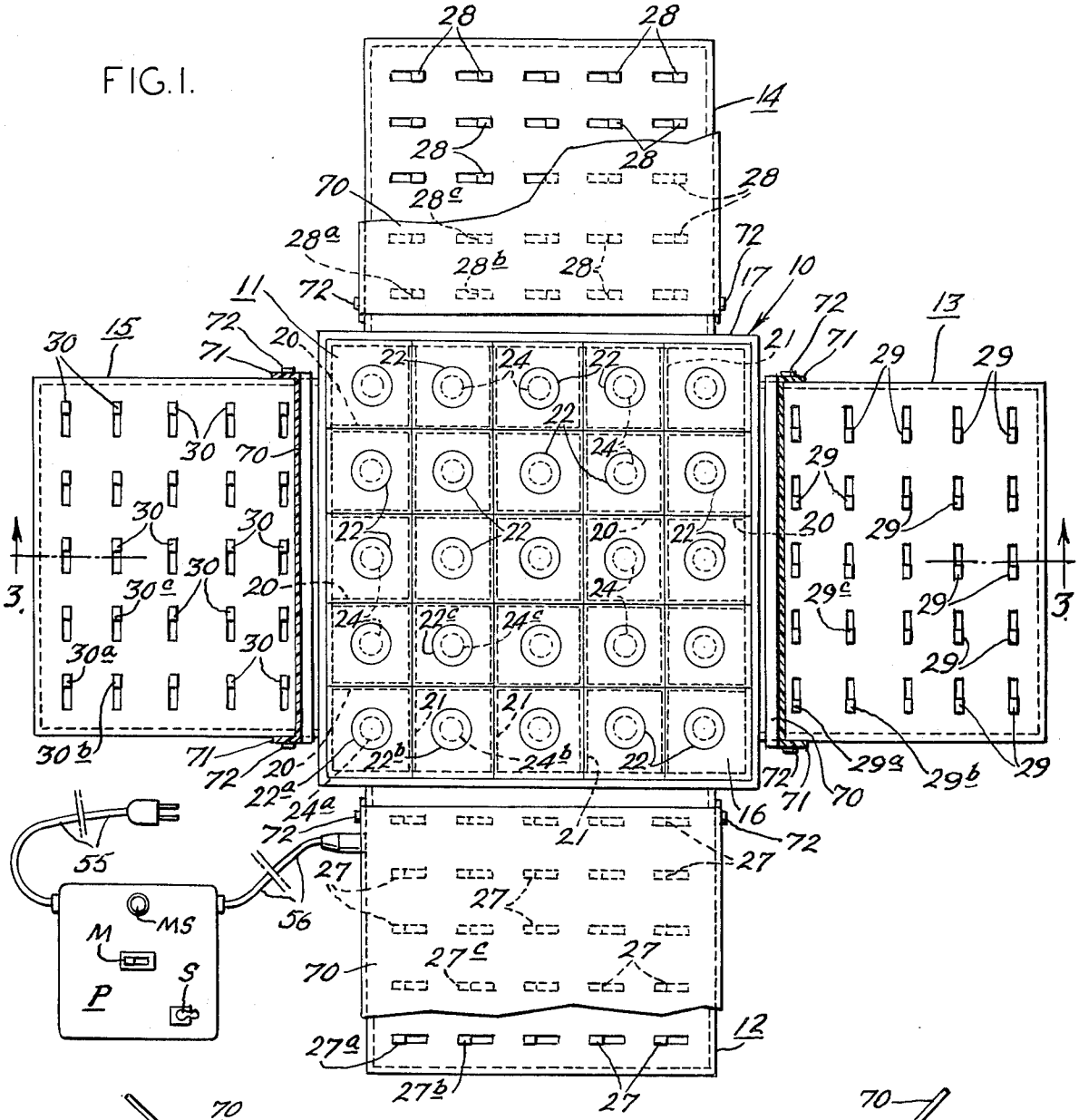
FIG. 1 is a plan view of a preferred embodiment of a game device constructed according to the present invention.

Referring now to the drawings, FIG. 1 illustrates a game device 10 embodying the present invention. As best seen therein, the game device 10 comprises a game board 11 and four playing stations 12, 13, 14 and 15 associated with the game board 11. In the illustrated embodiment, the game board 11 is square, and a pair of playing stations 12 and 14 extend outwardly in opposite directions from the lower and upper edges, respectively, of the game board 11. Another pair of playing stations 13 and 15 extend outwardly in a similar manner from opposite side edges of the game board 11. Thus, the game board 11 and associated playing stations define a generally cruciform plan configuration.

The game board 11 is divided into a series of playing spaces. To this end, the game board 11 comprises a translucent panel 16 surrounded by a frame 17 which provides a lamp chamber 18 below the panel 16. A grid composed of a series of intersecting partitions 20 and 21 is provided in the lamp chamber 18. The partitions 20 and 21 thus divide the game board 11 into a series of playing spaces 22, 22. In the illustrated embodiment, a total of 25 playing spaces 22, 22 are provided, five rows each containing five spaces. Preferably, the upper surface of the panel 16 is ruled or lined above the edges of the partitions 21 and 21 to delineate the playing spaces 22, 22.

Each playing space 22 is illuminated by its own lamp 24. Preferably, the lamps 24, 24 are removably secured in sockets 25, 25 securely fastened in a socket panel 26 extending across the lamp cavity 18 below the board panel 16. The partitions 20 and 21 are resistant to the transmission of light in the lateral direction so that light emitted from each lamp 24 travels upwardly through the panel 16 to illuminate the playing space 22 above the lamp. Thus, the illuminated spaces can be distinguished from dark ones even in well lighted rooms.

The lamps 24; 24 are selectively illuminated from each playing station. For this purpose, each playing station, such as the playing station 12, is provided with a series of switches 27, 27 having actuators arranged in a pattern similar to the pattern in which the playing spaces are arranged on the game board 11. The other playing station 14 of the pair 12 and 14 also has similar switches 28, 28. The playing station 13 has switches 29 and 29, and its complementary playing station 15 has switches 30 and 30.

The switches 27 and 28 are connected with the switches 29 and 30 by circuit means which enables all four switches to control the illumination of a common playing space 22 on the board 11. The circuit is designed so that the locations of the switches 27, 28, 29 and 30 at the playing stations 12, 14, 13 and 15 correspond to the location on the board of the common playing space 22 which they control. For example, the switch **27*a* at the lower lefthand corner of the playing station 12 controls the illumination of the lamp 24*a* for the playing space 22*a* located at the lower lefthand corner of the playing board 11. The adjacent switch 27*b* of the playing station 12 controls the illumination of the lamp 24*b* for the playing space 22*b*. The other switches in the bottom row of the playing station 12 control the remaining playing spaces in the bottom row of the playing board 11. The switches 27*c*, 28*c*, 29*c* and 30*c* control the illumination for the playing space 22*c*, and so on. Thus, the switches at each playing station are so connected with the lamps for the various playing spaces on the playing board 11 as to correspond spatially therewith as the board 11 is viewed from each playing station. This structure enables the players to orient themselves rapidly at each playing station with respect to the pattern of playing stations on the game board 11**.

In the present invention, the switches 27, 28, 29 and 30 are connected together by circuit means which causes the lamp 24 connected in common therewith to be illuminated when an odd number (1 or 3) of the switches are in the same positions and to prevent such illumination when an even number (2 or 4) of the switches are in the same positions. For instance, if switches 29*a* and 30*a* were off and the switch 27*a* were on and the switch 28*a* off, or vice versa, the lamp 24*a* would be illuminated. If both switches 27*a* and 28*a* were on, the lamp 24*a* would not be illuminated.

Figure 4:
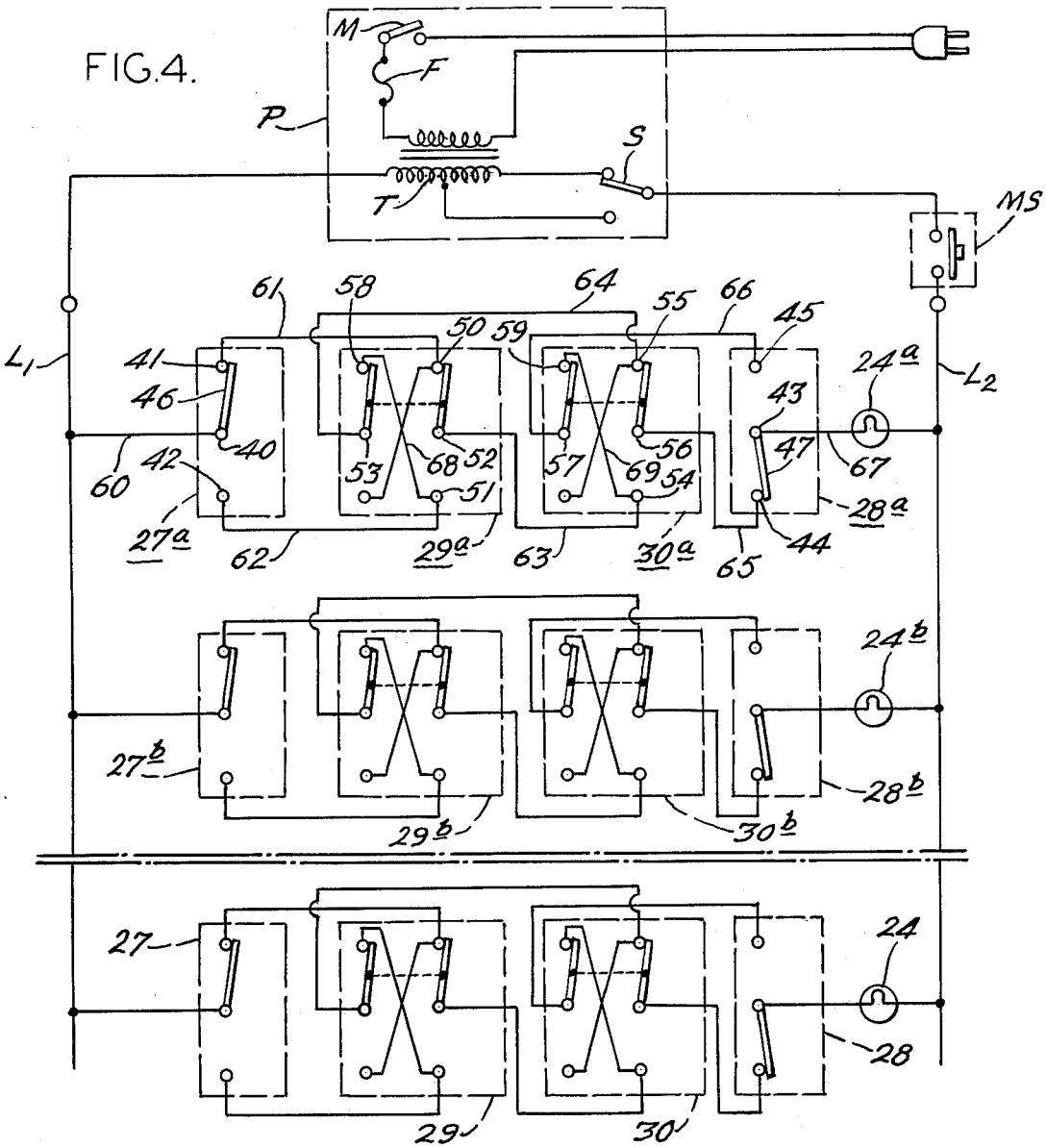
FIG. 4 is an electrical schematic diagram of the illustrated four playing station game device.

The switches 27–30 are arranged so that all of their actuators are in the same relative position when off. For instance, in the illustrated embodiment, the switches are off when their slide actuators are in their leftwardmost limit positions when looking toward the board. In order to cause all of the playing spaces 22 to be dark when the switches are in their off positions, one switch in each group of four is disposed opposite the others. For example, as seen in FIG. 4, the switches 27*a*, 29*a* and 30*a* are all shown with their contactors in the same normally-closed positions. The contactor for the switch 28*a*, however, is disposed in the opposite normally-open position. Thus, even though all of the switch actuators are at the left, power is not supplied to the lamp 24*a*. The same result can be achieved by an opposite disposition of any one of the other switches in the group.

The switches 27–30 are connected together in a novel manner to enable games to be played with as few as two players situated at opposite or adjacent playing stations. For instance, players situated at opposite stations 12 and 14 could actuate switches 27 and 28 to play against one another, or if they were situated at adjacent playing stations 12 and 13, they could actuate switches 27 and 29 to play against one another. Of course, when only two players are playing, the other switches are all in their off positions.

The above may be seen by reference to FIG. 4. With players at opposite stations 12 and 14, the switches 29*a* and 30*a* are off, and when either switch 27*a* or 28*a* is placed in the on position, the lamp 24*a* is illuminated. When both switches 27*a* and 28*a* are in the on position, the lamp 24*a* is out. With players at adjacent playing stations 12 and 13, the switches 28 and 30 are off, and when either switch 27*a* or 29*a* is in the on position, the lamp 24*a* is illuminated. When both switches 27*a* and 29*a* are in the on position, the lamp 24*a* is out.

In the illustrated embodiment, a typical pair of switches 27 and 28 for the playing stations 12 and 14, respectively, include conventional single-pole double-throw slide switches. Each switch, such as the switch 27*a*, has an input terminal 40 and double output terminals 41 and 42. The switch 28*a* also has corresponding input and output terminals 43, 44 and 45. The switch 27*a* has a contactor 46, and the switch 28*a* has a contactor 47.

The typical pair of switches 29*a* and 30*a* of the playing stations 13 and 15, respectively, include conventional double-pole double-throw slide switches. Each of these switches, such as the switch 29*a*, has a pair of input terminals 50 and 51 and two output terminals 52 and 53. The switch 30*a* has similar terminals 54–57.

Referring now to FIG. 4, it may be seen that the control switches are connected in parallel in groups of four across power supply lines $L_1$ and $L_2$. Typically, in the switch group 27*a*–30*a*, the input terminal 40 of the single pole switch 27*a* is connected directly to power line $L_1$ by a lead 60, and its output terminals 41 and 42 are connected to input terminals 50 and 51 of the adjacent double-pole switch 29 by leads 61 and 62, respectively. The output terminals 52 and 53 of the double pole switch 29*a* are connected to input terminals 54 and 55 of the adjacent double pole switch 30*a* by leads 63 and 64, respectively. The output terminals 56 and 57 of the double pole switch 30*a* are connected to the input terminals 44 and 45 of the single pole switch 28*a* by leads 65 and 66, respectively. The output terminal 43 of the switch 28*a* is connected by a lead 67 through the lamp 24*a* to power line $L_2$. The connected input terminals 51 and 54 of the double pole switches 29*a* and 30*a* are cross-connected to the terminals 58 and 59 by leads 68 and 69, respectively to complete the circuit interconnections.

The other switches in the groups 27*b*–30*b* and 27*c*–30*c* are similarly connected across the power lines $L_1$ and $L_2$ to the lamps 24*b* and 24*c*.

Figure 3:
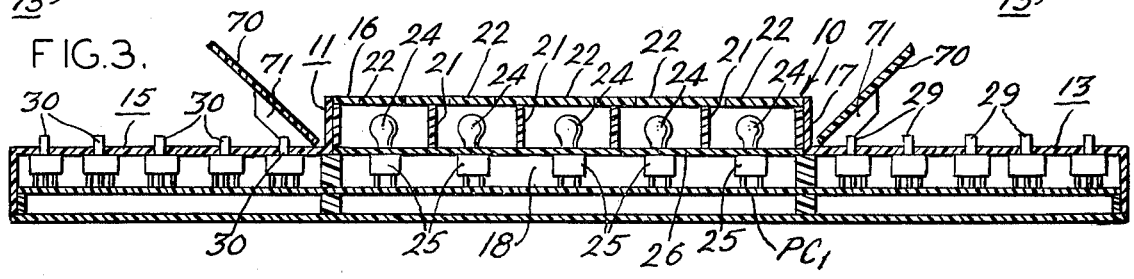
FIG. 3 is a sectional view taken on line 3—3 of FIG. 1.

Although the various switches may be wired by separate leads, it is preferable for the various interconnections to be provided by a printed circuit such as carried by a printed circuit panel $PC_1$ (FIG. 3).

The power lines $L_1$ and $L_2$ are supplied with power from a power pack P which has a cord 55 adapted to be plugged into a conventional receptacle and which has a cord 56 connecting it to the game board 11. The power pack P encloses a transformer T which functions to reduce line voltage to a relatively safe level of about 8 volts AC across the lines $L_1$ and $L_2$. Preferably, the transformer T is of the center-tap type, and a switch S is provided to enable the lamps to be supplied with a slightly greater or lesser level of voltage in order to provide a greater or lesser amount of illumination, as desired, depending on the ambient illumination of the room in which the game device 10 is being used. A fuse F and a main switch M are provided in the primary circuit of the transformer T. Power is supplied to the low-voltage lines $L_1$ and $L_2$ through a master switch MS which functions to illuminate simultaneously those lamps for which their control switches are in the appropriate positions, as explained above.

The game device 10 is intended to be played with game pieces (not shown) which are moveable from playing space 22 to playing space 22 on the playing board 11. The movement of the playing pieces is determined by the locations of illuminated ones of the various playing spaces at the beginning of each player's turn as the game proceeds in accordance with prescribed rules. Since one player can anticipate, and hence block, an intended move of the other player simply by a proper manipulation of the switches at his playing station, it is important for the switches at one playing station to be concealed from view from the other playing station. For this purpose, each playing station, such as the playing station 13, is provided with a shield 70 having a pair of depending webs 71, 71 which are pivotally connected to opposite sides of the playing station 13 by pivot pins 72, 72. Preferably, the shield 70 is dimensioned so as to substantially cover the playing station 13 when ever shield 70 is pivoted downwardly into its storage position illustrated in broken lines in FIG. 2. When the game device 10 is in play, of course, each shield 70 is pivoted counter-clockwise into the position illustrated in full lines in FIG. 2 to prevent the switches at the playing station 13 from being seen from the other playing stations.

Figure 2:
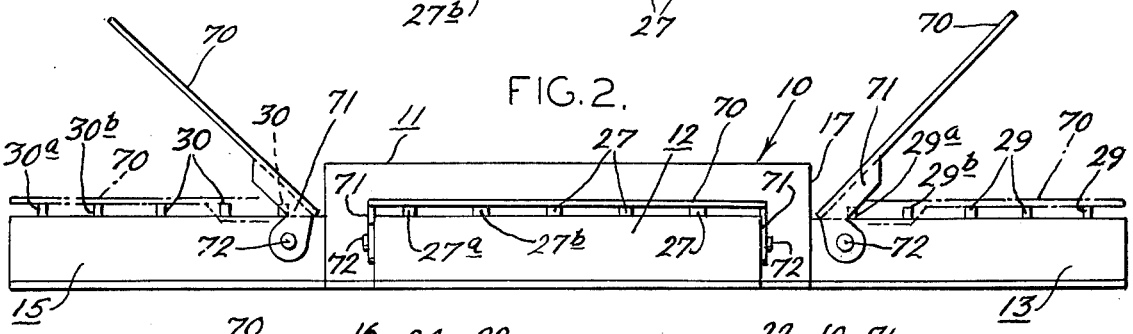
FIG. 2 is a side elevational view thereof.
Figure 5:
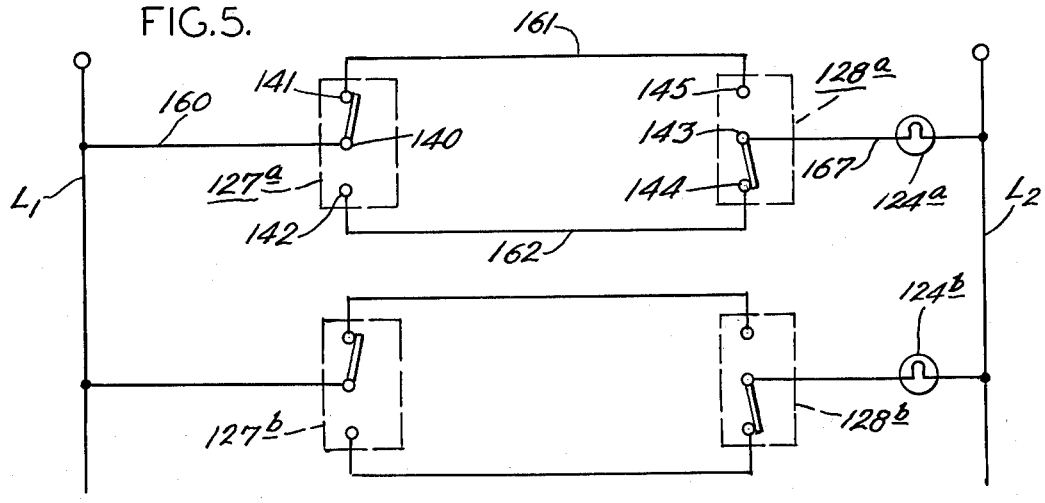
FIG. 5 is an electrical schematic diagram of a modified game device having only two playing stations.

A modified game device may be provided wherein only two playing stations are provided rather than the four illustrated in FIGS. 1-3. In such event, the device would be substantially the same as described heretofore; however, the switches at the opposite playing stations would be connected together in the manner illustrated schematically in FIG. 5. Thus, only two single-pole, double-throw switches 127*a* and 128*a* are necessary. The input terminal 140 is connected to power line $L_1$ by a lead 160, and the output terminals 141 and 142 are connected to the input terminals 145 and 144 by leads 161 and 162, respectively. The output terminal 143 is connected by a lead 167 through the lamp 124*a* to the other power line $L_2$. Thus, when one switch is in a position opposite the other, i.e., one on and the other off, the lamp 124*a* is illuminated. However, when both are on, the lamp 124*a* is off. The other switches 127*b* and 128*b* are similarly connected in a parallel pair or group with the switches 127*a* and 128*a* across the power lines $L_1$ and $L_2$. The same power pack P may be connected to the power lines $L_1$ and $L_2$ and employed in connection with the two-station game device in the manner described heretofore.

Having thus described the structure and operation of two embodiments of the game device 10, the following are examples of games which may be played using the device 10. It should be understood, however, that these examples are given by way of illustration only, and they are not intended to limit the use of the game device in any way since various other games may be played on the device 10.

The game device 10 may be used to play the well-known game of tic-tac-toe. In playing the game, two players are preferably situated at opposite playing stations, such as the playing stations 12 and 14. In the game, the innermost nine playing spaces and their corresponding control switches are manipulated, and the switches along the outer edges of the playing stations are maintained in their off positions. At the start of the game, all of the switches are slid leftward into their off positions, and the master switch MS is closed to supply power to the lead $L_1$ and $L_2$. At such time, all of the playing spaces on the board 11 should be dark.

In playing the game of tic-tac-toe, each player is permitted to actuate one of the nine switches during each of his turns. His object is to cause one or more spaces on the board 11 to be illuminated so that he may position his playing piece on the illuminated spaces. The object of his opponent, of course, is to anticipate which space the player will illuminate and to block or afford such move by placing his switch in the proper position. Thus, if the player at station 12 were to turn on the switch 27*c* to illuminate playing space 22*c,* his opponent could block such illumination simply by turning on switch 28*c* at playing station 14. Of course, the player may feint and not turn on any switch, in which case the playing space 27*c* would be illuminated if his opponent actuated the switch 28*c.* After the player and his opponent have actuated (or not actuated) a switch, each indicates ready and the master switch MS is closed to supply power to those lamps for which only one switch has been closed. It should be apparent that if the player turns on one switch for one playing space, and his opponent turns on a switch for another playing space, two playing spaces will be illuminated when the master switch MS is closed. Thus, the player is permitted to position two playing pieces on the board 11. Of course, if his opponent anticipates properly the player's action, none of the playing spaces will be illuminated, and the player will not be permitted to place any playing piece on the board 11. After the player has his turn, all of the switches at both the player's and opponent's playing stations are turned to their off positions, and the opponent then becomes the player. The game proceeds with each person taking turns in rotation until one or the other is victorious or the game results in a draw.

The game device 10, of course, is designed to be played with four players. An example of a game which may be played satisfactorily by four players will now be described. In this game the object is for each of the four players to place playing pieces on the board 11 and to advance the playing pieces across the board from his playing station to the playing station opposite him. This game can be played with each person acting as an individual or with a partner. If the game is played with each player acting individually, he receives three playing pieces. If, however, the game is played with partners, each team receives a total of five playing pieces.

A player is permitted to place one or more playing pieces on the board 11 when one or more illuminated spaces appear in the first row adjacent his playing station. He may advance the playing pieces forwardly and laterally, but not diagonally, on adjacent lighted playing spaces.

At the beginning of the game, the player is permitted to set up to five switches, and his opponent or opponents are also permitted to set up to five switches in an effort to counter his action. Of course, if he is playing with a partner, his partner may also set five switches in an effort to aid the player. After all of the switches have been set, the master switch MS is closed, and depending upon the skill with which the players and opponents anticipate one another's moves, one or more or none of the playing spaces will be illuminated. After the player places the appropriate number of playing pieces on the lighted playing spaces, all of the switches at the various playing stations are returned to their off positions; the previous opponent or opponents become the players; and the game continues in this manner clockwise or counter-clockwise around the board. Should an illuminated playing space during a player's turn already contain a playing piece, that playing piece is removed from the board and replaced by the player's piece, and the player possessing the removed piece must begin again.

In another game, played by up to four players, only the playing spaces around the periphery of the board 11 are employed. This game is in the nature of a race wherein game pieces are started at one location and progress around the periphery of the board on lighted spaces.

From the foregoing, it should be apparent that the game device 10 lends itself to use in playing a wide variety of games wherein one or more players pit their wits against one or more opponents. The game device 10 lends itself readily to play by children since it enables them to make up their own rules. As exemplified above, many challenging games can be played by adults using the game device 10.

In the illustrated embodiments, the lamps are incandescent. It should be understood, however, that other forms of satisfactorily such as light emitting diodes may be employed saytisfactorily instead.

While preferred embodiments of the present invention have been described in detail, and certain methods of play given by way of example, various modifications, alterations and changes in the structure of the game device and its method of play may be employed without departing from the spirit and scope of the present invention as defined in the appended claims.

I claim:

1. A game device, comprising:

a game board, means dividing said game board into a series of playing spaces arranged in a preselected pattern, electrically-energizable means carried by said board for separately illuminating said playing spaces, at least two playing stations associated with said game board, a series of control switches corresponding in number to said playing spaces and having actuators mounted at each playing station, circuit means electrically connecting the switches at one playing station with the switches at the other playing station and with said illuminating means for said spaces so that one switch at each playing station controls the illumination of one of said playing spaces, and means for supplying electrical power to said circuit means to illuminate each playing space for which an odd number of its control switches are in an on position and to prevent illumination of each playing space for which an even number of its control switches are in on position.

2. A game device according to claim 1 wherein said control switch actuators are arranged at each playing station in a pattern corresponding to the pattern of the playing spaces which they control as the board is viewed from the playing station.

3. A game device according to claim 1 including shield means adapted to extend upwardly in front of each playing station to substantially conceal the switches at one playing station from view from the other playing station.

4. A game device according to claim 1 wherein said circuit means connects said switches in groups composed of the same number of switches as there are playing stations, said groups being connected in electrical parallel relation with one another, and wherein said power supplying means includes master switch means connected in said circuit means for simultaneously illuminating all playing spaces for which said odd number of switches are closed.

5. A game device according to claim 1 including an additional pair of playing stations associated with said game board, said additional pair being like in construction to said first-mentioned pair of playing stations and each having a like series of similarly arranged control switches and actuators, said circuit means connecting said control switches at said additional pair of playing stations to the control switches for said first-mentioned pair of playing stations so that the switches control the illumination of said one playing space and cause said one playing space to be illuminated only when said odd number of switches are in their on positions.

6. A game device according to claim 1 wherein said game board includes a translucent panel, and said illuminating means includes lamps mounted below the playing spaces of said panel and grid means arranged in said pattern separating said lamps from one another so that light is emitted upwardly when the lamps are selectively energized.

7. A game device according to claim 1 wherein said control switches are mounted at said playing stations so that their actuators are all disposed in the same position relative to the board when they are in their off positions.

* * * * *